US006090191A

United States Patent [19]

Atlanova et al.

[11] Patent Number: 6,090,191

[45] Date of Patent: Jul. 18, 2000

[54] COMPOUND FOR PRODUCING A METAL-CERAMIC COATING

[75] Inventors: Aza Fedorovna Atlanova; Galina Andreevna Babaeva, both of Moscow; Evgeny Alexeevich Belov, Moskovskaya oblast; Dina Ivanovna Dubovik, Moscow; Jury Alexandrovich Pestov; Margarita Evgenievna Judina, both of Moskovskaya oblast; Leonid Vasilievich Cherkasov, Moscow; Vadim Iliich Semenov; Felix Jurievich Chelkis, both of Moskovskaya oblast; Alexandr Mikhailovich Kashkarov, Moscow; Konstantin Pavlovich Khaplanov, Moskovskaya oblast, all of Russian Federation

[73] Assignee: Oktrytoe Aktsionernoe Obschestvo "Nauchno-Proizvodstvennoe Obiedinenie "Energomash" Imeni Akademika V.P. Glushko", Moskovskaya oblast, Russian Federation

[21] Appl. No.: 09/407,947

[22] Filed: Sep. 29, 1999

[30] Foreign Application Priority Data

Feb. 23, 1999 [RU] Russian Federation ..... 99103553

[51] Int. Cl.[7] ..... C22C 29/12; C09K 5/00

[52] U.S. Cl. ..... 106/14.05; 75/232; 75/233; 75/234; 75/235; 75/245; 75/246; 428/469; 428/471; 428/472; 428/472.2; 428/697; 428/702

[58] Field of Search ..... 106/14.05; 75/232, 75/233, 234, 235, 245, 246; 428/469, 471, 472, 472.2, 697, 702

[56] References Cited

U.S. PATENT DOCUMENTS

| | | | |
|---|---|---|---|
| 3,891,452 | 6/1975 | Low et al. | 501/15 |
| 3,906,124 | 9/1975 | Carini et al. | 427/309 |
| 4,289,447 | 9/1981 | Sterman et al. | 428/598 |
| 5,075,263 | 12/1991 | Schittenhelm et al. | 501/25 |
| 5,516,595 | 5/1996 | Newkirk et al. | 428/697 |

FOREIGN PATENT DOCUMENTS

| | | |
|---|---|---|
| 462808 | 5/1975 | Germany . |
| 916458 | 3/1982 | Germany . |

OTHER PUBLICATIONS

Derwent Abstract No. 1983–721077, abstract of Soviet Union Patent Specification No. 958358. (Sep. 1982).

Derwent Abstract No. 1987–099412, abstract of Soviet Union Patent Specification No. 1248976. (Aug. 1986).

Derwent Abstract No. 1989–120881, abstract of Soviet Union Patent Specification No. 1430377. (Oct. 1988).

Derwent Abstract No. 1989–191282, abstract of Soviet Union Patent Specification No. 1447763. (Dec. 1988).

Derwent Abstract No. 1992–157732, abstract of Soviet Union Patent Specification No. 1654277. (Jun. 1991).

P.T. Kolomytsev, *High–Temperature Protective Coatings for Nickel Alloys*, Moscow, Metallurgiya Publishers, 1991 (no month).

S.S. Solntsev, "*Protective Technologic Coatings and High–Melting Enamels*" Moscow "Mashinostroyeniye" 1984 (no month).

The USSR Academy of Sciences, The Institute of Silicate Chemistry after L.V. Grebenschikov "*Refractory Inorganic Coatings*" Transactions of the 13th All–Union Colloquium on Refractory Coatings, Leningrad, 14–16th of Apr., 1987. Leningrad, NAUKA Publishers, Leningrad Branch, 1990. (no month).

*Primary Examiner*—Anthony Green
*Attorney, Agent, or Firm*—Banner & Witcoff, Ltd.

[57] ABSTRACT

The invention relates to the field of producing the means for protecting the alloys on the nickel base against the influence of corrosive media, and more particularly concerns the metal-ceramic coatings used for protecting the flow parts of the turbines of turbopump liquid-propellant rocket engines (LRE). The composition for producing the metal-ceramic coating consists of nickel and of oxides of barium, boron, aluminum, cerium and zirconium at the following percentage of components by mass: nickel—36–58, barium oxide—16–19, boron oxide—7–13, aluminum oxide—6–9, cerium oxide—14–19, zirconium oxide—1–2. The coating is produced of a slip, that is applied to the pieces by dipping, spraying or flooding. The slip layers are dried in the flow of hot air. The coating is fired in a furnace in the inert gas medium, argon for example, at a temperature of 1000–1100° C. during 0.5–1 hour. The use of the composition for producing a metal-ceramic coating for the pieces and units of complicated shape made of nickel alloys with a layer of nickel secures their serviceability and reliability at a cyclic action of a high-temperature flow of oxidizing generator gas containing the particles of AMg6 alloy at the temperature of up to 900° C.

1 Claim, No Drawings

COMPOUND FOR PRODUCING A METAL-CERAMIC COATING

The invention relates to the field of coatings for protecting the surface of alloys on a nickel base against the action of corrosive mediums under the operating conditions of a turbopump unit. In particular, the invention relates to the makeup of metal-ceramic coatings which are applied to the aforesaid alloys, preliminarily coated with a nickel layer.

The use of glass-enamel and glass-ceramic coatings, directly applied onto an alloy without an intermediate nickel layer, for protection of nickel alloys against ignition is known (S. S. Solntsev "Protective technological coatings and high-melting enamels," Moscow, Mashinostroenie, 1984). These coatings are resistant to the action of high-speed gas corrosion (to 900° C.). However, under the operating conditions of a turbopump unit, it is necessary to deal with a high-speed and high-temperature (to 900° C.) flow of pure oxygen and with a flow of oxygen comprising particles of the AMg6 alloy (makeup, %; Al—base, Mg—5.8–6.8, Mn—0.5–0.8, Ti—0.02–0.1, Be—0.0002–0.1, Fe—0.4, Si—not more than 0.4, C—not more than 0.2, Cu—not more than 0.1), which may cause ignition. Therefore the described glass-enamel and glass-ceramic coatings do not solve the problem of providing protection against ignition in the aforesaid operating conditions of a turbine pump unit, and they already fail at a temperature of about 650° C.

In order to enhance the resistance of a ceramic layer, metal powders, in particular nickel powder, are added to its makeup. This results in enhancement of the strength of adhesion between the coating and the alloy and, accordingly, to erosion resistance, resistance to the cyclic action of temperature and vibratory loads, and also to enhancement of plasticity as compared with ceramic or glass-ceramic coatings which do not comprise nickel (Inventor's Certificate No. 916458, class C 03 C 8/16, 8/06; A. A. Appen "Temperature-resistannt inorganic coatings," Leningrad, "Khimiya," 1976, pp. 157–159).

However, under operating conditions of a turbopump unit at temperatures to 900° C., the known coatings melt and are carried away by the flow.

The use of metal coatings, including nickel, is known for protection of alloys against oxidation. A nickel layer is resistant to ignition, but is not sufficiently resistant to the erosive action of particles of AMg6 alloy, as a result of which the nickel coating is carried away by those particles. Therefore, the nickel layer is in need of corresponding protection.

Protective coatings on a nickel layer, which are provided by nickel aluminides (P. T. Kolomytsev "High-temperature protective coatings for nickel alloys," Moscow, Metallurgiya, 1991, pp. 58–59) and by glass enamels (V. A. Efimova, V. V. Gerasimov "Polyphosphate coatings for ferrous and non-ferrous metals" in the collection "Heat-resistant inorganic coatings," Papers of the 13th All-Union Conference on Heat-resistant Coatings, Leningrad, Apr. 14–16, 1987, pp. 71–73), are known.

However, these coatings cannot ensure reliable protection and serviceability of the gas path of a turbine because of brittleness, spalling and ignition in the flow of oxygen with particles of the AMg6 alloy at temperatures of about 600° C.

The coating most similar to the proposed coating is the protective coating of refractory oxides (P. T. Kolomytsev "High-temperature protective coatings for nickel alloys," Moscow, Metallurgiya, 1991, pp. 58–59). However, such coatings are also brittle and ignitable under the aforesaid conditions.

The object of the invention is to create a metal-ceramic coating intended for protection of articles made of nickel alloys, preliminarily coated with a protective layer of nickel, in particular the flow-through part of the turbines of turbopump liquid-propellant rocket engines (LRE), which coating is resistant to the heat cycling and erosive action of the high-speed and high-temperature (to 900° C.) flow of oxygen-comprising gas comprising ignition-initiating particles.

The object of the invention is achieved in that a composition is proposed for producing the aforesaid metal-ceramic coating, the composition comprising, by weight:

| | |
|---|---|
| Nickel | 36–58 |
| Barium oxide | 16–19 |
| Boron oxide | 7–13 |
| Aluminum oxide | 6–9 |
| Cerium oxide | 14–19 |
| Zirconium oxide | 1–2. |

The produced coating protects a nickel layer, withstands the cyclic action of the high-speed and high-temperature flow of oxidizing generator gas without destruction, and is resistant to the action of AMg6 alloy particles.

In order to approbate the proposed composition for producing a metal-ceramic coating on articles made of nickel alloys with a nickel coating, finely divided powders of nickel (Ni), oxides of cerium ($CeO_2$), zirconium ($ZrO_2$), aluminum ($Al_2O_3$), barium (BaO), and boron ($B_2O_3$) were taken. Water was added to the prepared composition and a slip was made.

The slip was applied to the articles by dipping, spraying or flooding depending on the complexity of the article shape.

The slip layers were dried in air, in a drying chamber or in a hot air flow.

The coating was fired while being heated in a furnace in an inert gas medium, for example, argon, at a temperature of 1000–1100° C. during 0.5–1 hour.

Plates of EP741NP 30×40×2 mm nickel alloy were taken as samples, as well as blades 70 mm long, 12 mm wide, and 3 mm thick, and a one-piece turbine wheel of an LRE turbopump unit having an electroplated coating layer, 50–100 $\mu$m thick, on a nickel base.

A slip on the basis of a composition with the content of components indicated in Table 1 was made in accordance with the makeup, applied to the samples and to a turbine wheel, as articles, by dipping. The samples and the article were dried in a flow of hot air. The samples and the article with the applied coating were fired in a container filled with argon at a temperature of 1000° C. during 30 minutes.

The strength of adhesion between the coating and a substrate, thermal stability and ignition resistance of the blade samples with the coating were assessed. The adhesion strength was assessed on the basis of the character of the spalling after an impact of 0.5 kgf M on an impact testing machine. A coating, withstanding 50 thermal cycles of heating to 900° C. and cooling to 20° C. in water with repeated heating without destruction, was considered to have thermal resistance.

The resistance to ignition was determined in a flow of gaseous oxygen at a temperature to 900° C. while feeding AMg6 alloy particles of less than 0.4 mm in size and 0.05 g in weight.

The makeups of a composition for producing metal-ceramic coatings in accordance with the present invention with minimum, maximum and average values of the content of initial components and the makeup of the known composition are presented in Table 1.

TABLE 1

| Makeup number | Makeup, % by weight | | | | | |
|---|---|---|---|---|---|---|
| | Ni | BaO | $B_2O_3$ | $Al_2O_3$ | $CeO_2$ | $ZrO_2$ |
| 1. with minimum content of Ni, $Al_2O_3$, $CeO_2$, BaO, $ZrO_2$ | 36 | 16 | 13 | 6 | 14 | 1 |
| 2. with medium content of components | 47 | 17.5 | 10 | 7.5 | 16.5 | 1.5 |
| 3. with maximum content of Ni, $Al_2O_3$, $CeO_2$, BaO, $ZrO_2$ | 58 | 19 | 7 | 9 | 19 | 2 |

It was determined as a result of experimental studies that a reduction of nickel content in the proposed composition for producing a metal-ceramic coating below the minimum values causes embrittlement of the coating, a reduction of the content of boron oxide increases the temperature of firing, a reduction of the content of oxides of barium, aluminum, cerium and zirconium increases the amount of glass phase, reduces the temperature of firing and causes embrittlement of the coating and loss of strength of adhesion with the protected surface.

An increase of the content of the components indicated above, with the exception of boron oxide, above the maximum values, leads to the elevation of firing temperature and to the reduction of the mechanical strength of the coating. An increase of the amount of boron oxide leads to an increase of the glass phase, reduction of the firing temperature and the adhesion strength. The firing modes and coating properties are presented in Table 2.

TABLE 2

| No. | 1 | 2 | 3 |
|---|---|---|---|
| Coating (number from) Table 1) | 1 | 2 | 3 |
| Firing mode | | | |
| Temp., ° C. | 1000 | 1000 | 1000 |
| Firing duration min. | 30 | 30 | 30 |

TABLE 2-continued

| No. | 1 | 2 | 3 |
|---|---|---|---|
| Size and characteristic of spalling after an impact of 0.5 kgfM | a dent produced by a block head | a dent produced by a block head | a dent produced by a block head |
| Number of thermal cycles of 900° C. <--> 20° C. without destruction | not less than 50 | not less than 50 | not less than 50 |
| External appearance of coating After the test for ignition resistance | without changes | without changes | without changes |

As follows from the data presented in Table 2, the proposed coating reliably protects the nickel coating applied to an article of nickel-containing alloy against possible chipping, has a high adhesion strength, does not spall after an impact of 0.5 kgfM, and has high thermal resistance.

Samples with this coating withstand without ignition the action of AMg6 alloy particles which are blown into an oxidizing gas flow up to 20 times.

The testing of the composition for producing a metal-ceramic coating on a turbine wheel of a turbopump unit made of an EP741NP nickel alloy with a nickel coating, both during the overspeed test and during engine operation, even with AMg6 alloy particles blown in, showed that the produced coating is reliably held on articles of complex shape and is not destroyed by the action of vibratory loads. The use of the proposed composition for producing the metal-ceramic coating on articles and units of complex shape made of nickel alloys with a nickel layer ensures their serviceability and reliability during the cyclic action of a high-speed flow of oxidizing generator gas containing AMg6 alloy particles, at temperatures up to 900° C.

What is claimed is:

1. A composition for producing a metal-ceramic coating for protecting nickel-containing alloys preliminarily coated with a nickel layer, the composition comprising in by weight:

| | |
|---|---|
| Nickel | 36–58 |
| Barium oxide | 16–19 |
| Boron oxide | 7–13 |
| Aluminum oxide | 6–9 |
| Cerium oxide | 14–19 |
| Zirconium oxide | 1–2. |

* * * * *

UNITED STATES PATENT AND TRADEMARK OFFICE

CERTIFICATE OF CORRECTION

PATENT NO.: 6,090,191

DATED: July 18, 2000

INVENTORS: Aza ATLANOVA, *et al.*

It is certified that an error appears in the above-identified patent and that said Letters Patent is hereby corrected as shown below:

In Claim 1, column 4, line 40, after the word "in", --%-- has been inserted.

Signed and Sealed this

Tenth Day of April, 2001

*Attest:*

Nicholas P. Godici

NICHOLAS P. GODICI

*Attesting Officer*

*Acting Director of the United States Patent and Trademark Office*